US012434288B2

(12) United States Patent
Kim et al.

(10) Patent No.: US 12,434,288 B2
(45) Date of Patent: Oct. 7, 2025

(54) APPARATUS FOR ROLL STAMPING

(71) Applicant: POSCO Co., Ltd, Pohang-si (KR)

(72) Inventors: Don-Gun Kim, Incheon (KR); Myung-Hwan Cha, Incheon (KR)

(73) Assignee: POSCO CO., LTD, Pohang-si (KR)

( * ) Notice: Subject to any disclaimer, the term of this patent is extended or adjusted under 35 U.S.C. 154(b) by 176 days.

(21) Appl. No.: 18/025,259

(22) PCT Filed: Aug. 27, 2021

(86) PCT No.: PCT/KR2021/011489
§ 371 (c)(1),
(2) Date: Mar. 8, 2023

(87) PCT Pub. No.: WO2022/059963
PCT Pub. Date: Mar. 24, 2022

(65) Prior Publication Data

US 2023/0321711 A1 Oct. 12, 2023

(30) Foreign Application Priority Data

Sep. 17, 2020 (KR) ..... 10-2020-0119876

(51) Int. Cl.
*B21D 22/08* (2006.01)
*B21D 5/08* (2006.01)
*B21D 37/10* (2006.01)

(52) U.S. Cl.
CPC ..... *B21D 22/08* (2013.01); *B21D 5/08* (2013.01); *B21D 5/083* (2013.01); *B21D 37/10* (2013.01)

(58) Field of Classification Search
CPC ..... B21D 22/08; B21D 5/08; B21D 5/083; B21B 27/021; B21B 27/028; B21B 13/13
(Continued)

(56) References Cited

U.S. PATENT DOCUMENTS 7,107,807 B2 9/2006 Ingvarsson et al.
9,878,360 B2 1/2018 Kubo et al.
(Continued)

FOREIGN PATENT DOCUMENTS

DE 2354063 A1 * 5/1974
JP S59-27722 A 2/1984
(Continued)

OTHER PUBLICATIONS

English translate (DE2354063A1), retrieved date Nov. 3, 2024.*
(Continued)

*Primary Examiner* — Mohammed S. Alawadi
(74) *Attorney, Agent, or Firm* — Morgan Lewis & Bockius LLP

(57) ABSTRACT

An apparatus for roll stamping that is capable of expanding a shape range of a product without limitation due to, for example, a radius of curvature or a height of a variable section includes: an inclined roll set including a first rotation roll and a second rotation roll rotating while facing each other, have fixed positions and angles, and are inclined with respect to a traveling material, in which a first forming portion for forming the material is formed on an outer surface of the first rotation roll, the first forming portion includes a first circumferential groove portion inclined at an oblique angle rather than a right angle with respect to a rotation shaft of the first rotation roll.

12 Claims, 10 Drawing Sheets

(58) Field of Classification Search
USPC ..... 72/325
See application file for complete search history.

(56) References Cited

U.S. PATENT DOCUMENTS

| | | | | |
|---|---|---|---|---|
| 2004/0040357 | A1* | 3/2004 | Ingvarsson | B21D 5/083 72/181 |
| 2009/0025446 | A1* | 1/2009 | Ingvarsson | B21D 5/083 198/341.07 |
| 2010/0146789 | A1 | 6/2010 | Anderson et al. | |
| 2015/0251234 | A1* | 9/2015 | Daimaru | B21D 5/083 72/181 |
| 2019/0009319 | A1 | 1/2019 | Kim | |
| 2023/0321711 | A1 | 10/2023 | Kim et al. | |

FOREIGN PATENT DOCUMENTS

| | | | |
|---|---|---|---|
| JP | S63-154222 | A | 6/1988 |
| JP | H07-88560 | A | 4/1995 |
| JP | 5033120 | B2 | 7/2012 |
| JP | 5122863 | B2 | 1/2013 |
| JP | 2019-503869 | A | 2/2019 |
| KR | 10-2003-0087616 | A | 11/2003 |
| KR | 10-0510059 | B1 | 8/2005 |
| KR | 10-2013-0131872 | A | 12/2013 |
| KR | 10-2015-0013859 | A | 2/2015 |
| KR | 10-2018-0056164 | A | 5/2018 |
| KR | 10-2018-0072293 | A | 6/2018 |
| KR | 20180072293 | A * | 6/2018 |
| KR | 10-1888294 | B1 | 8/2018 |
| KR | 10-2022-0037205 | A | 3/2022 |
| KR | 10-2022-0090484 | A | 6/2022 |
| WO | 2014/045449 | A1 | 3/2014 |

OTHER PUBLICATIONS

English translate (KR20180072293A), retrieved date Nov. 3, 2024.*
Extended European Search Report issued Feb. 14, 2024 for European Patent Application No. 21869585.6.
Office Action issued Feb. 20, 2024 for Japanese Patent Application No. 2023-515785.
International Search Report dated Nov. 24, 2021 issued in International Patent Application No. PCT/KR2021/011489 (with English translation).
Decision to Grant dated Jul. 25, 2024, issued in corresponding Korean Patent Application No. 10-2022-0074279 with a partial English translation.

* cited by examiner

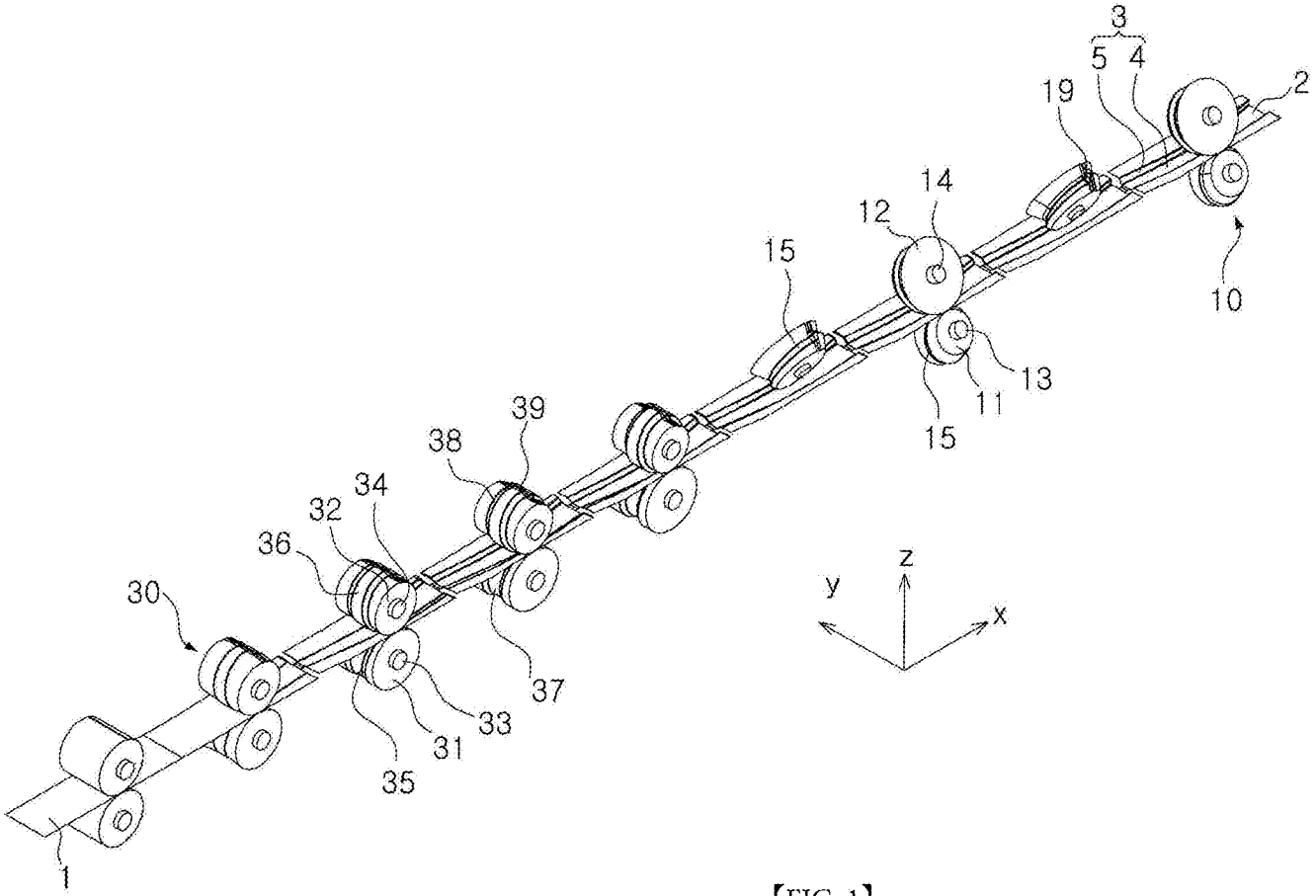
【FIG. 1】

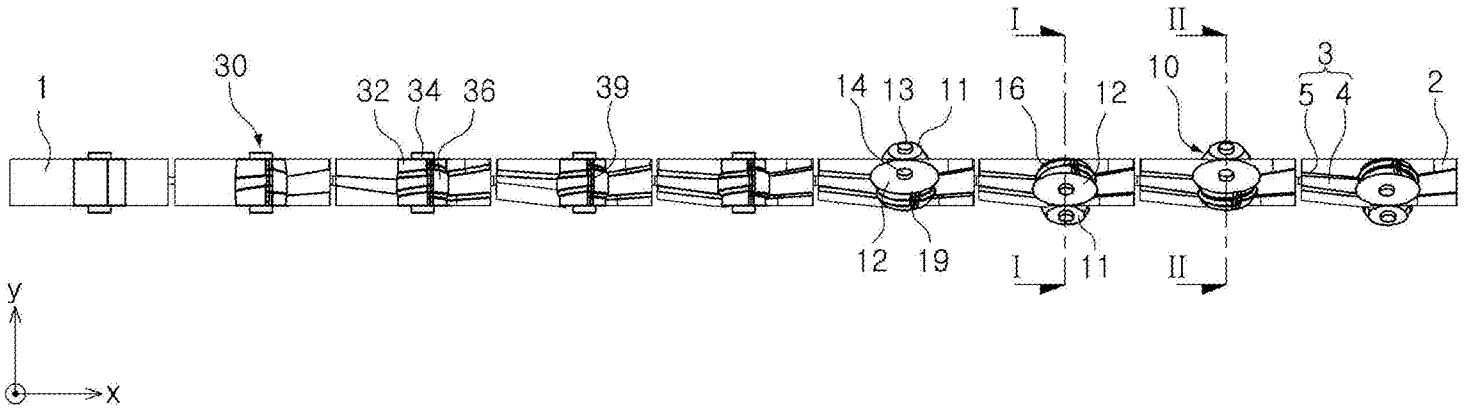
【FIG. 2】

【FIG. 3】
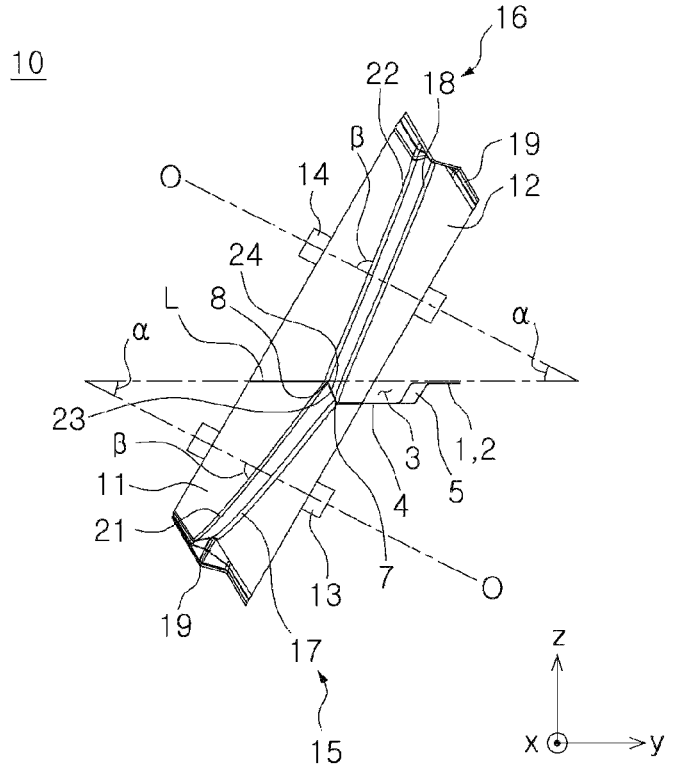

【FIG. 4】
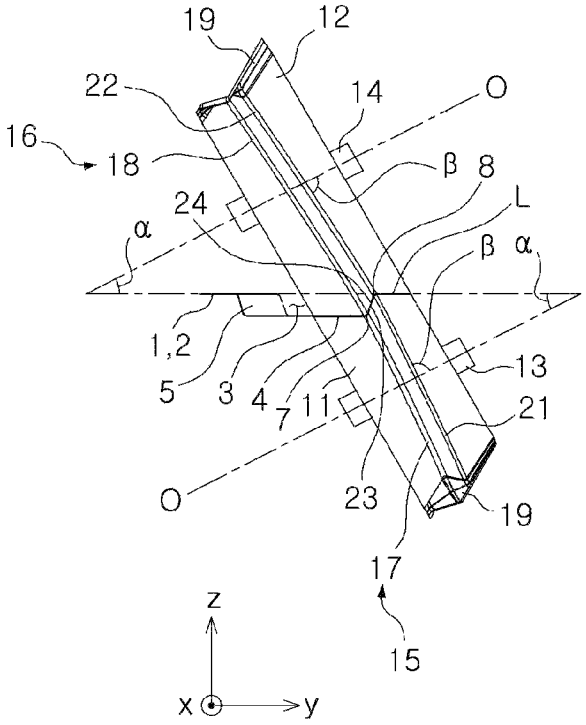

【FIG. 5】
(a)
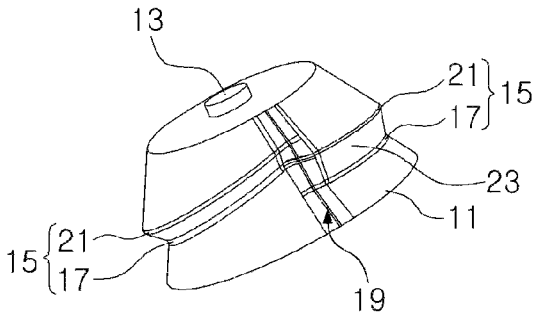
(b)
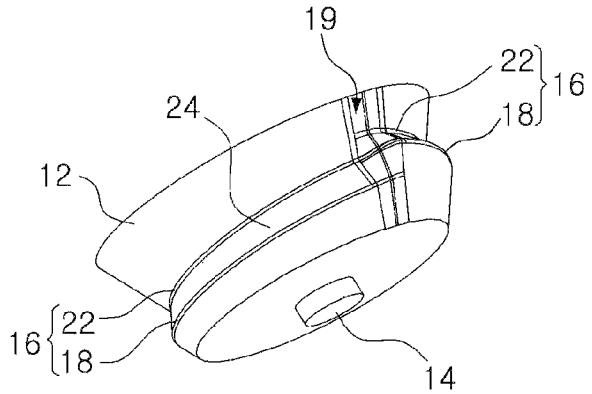

【FIG. 6】
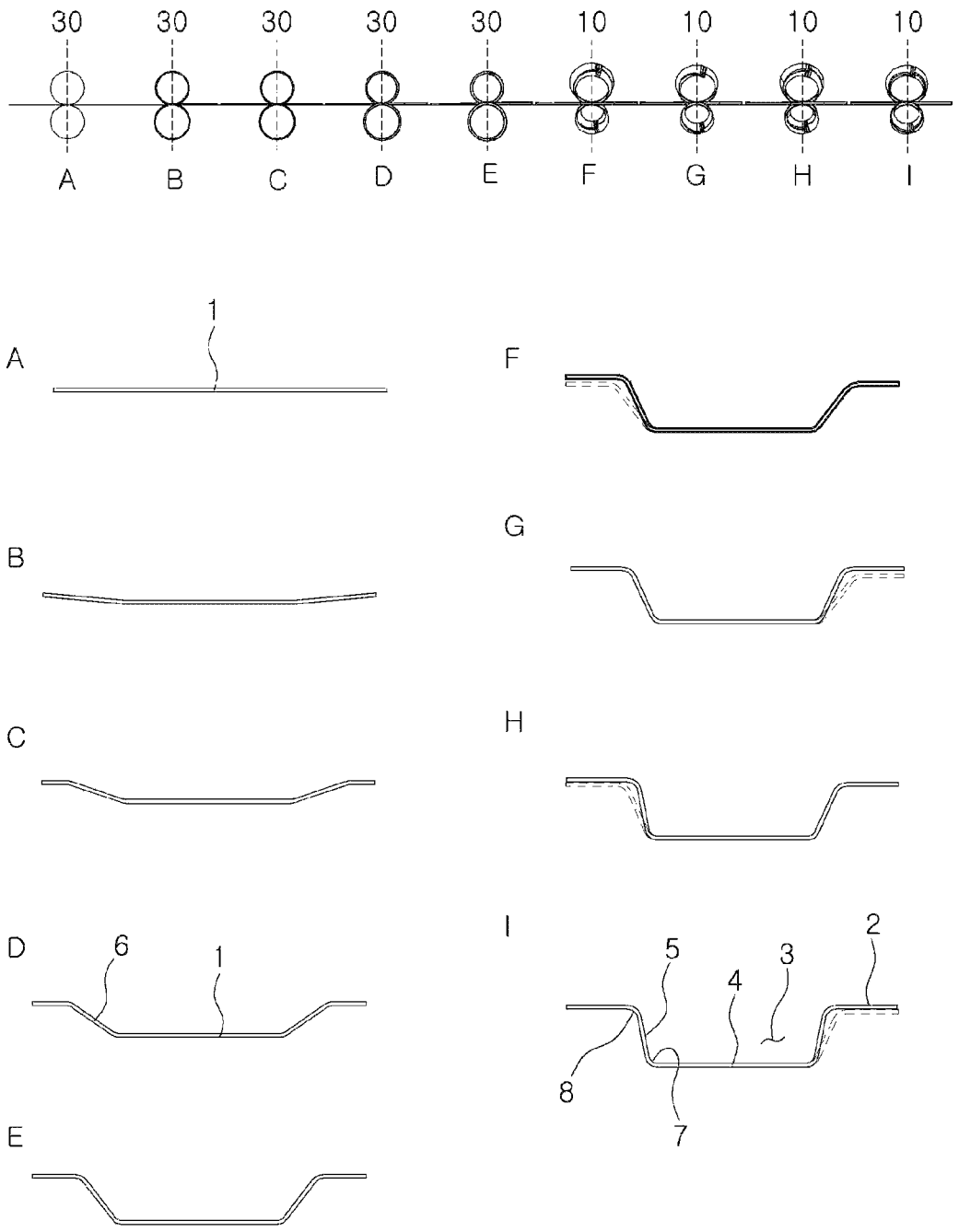

【FIG. 7】
(a)
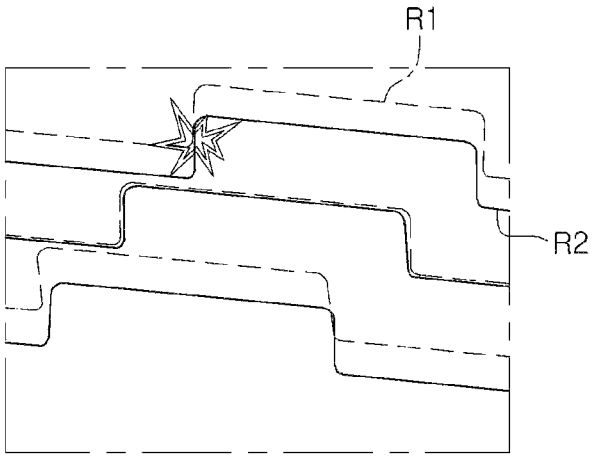
(b)
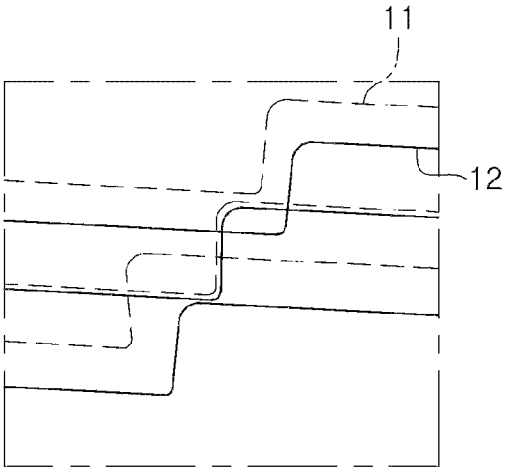

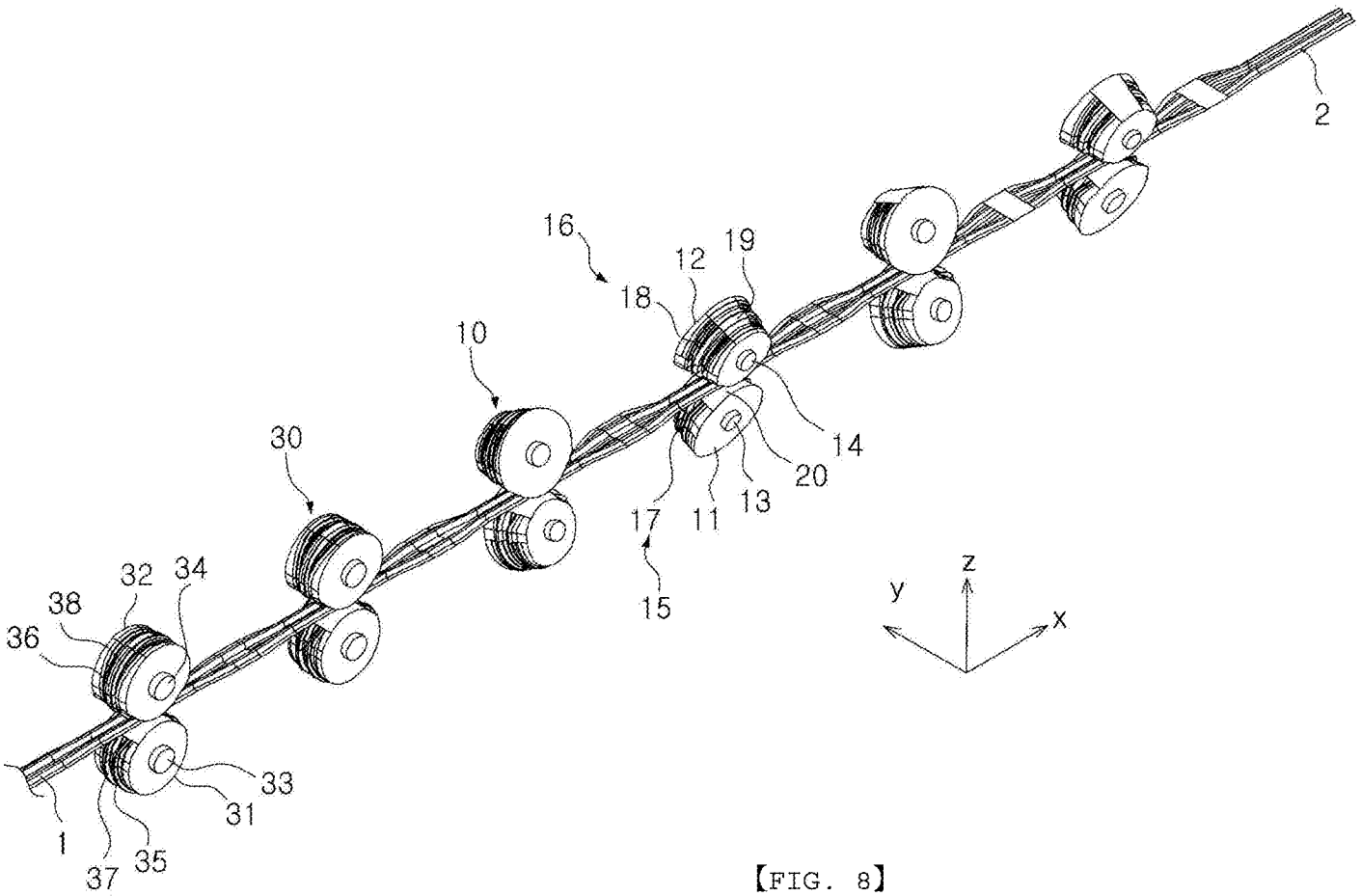
【FIG. 8】

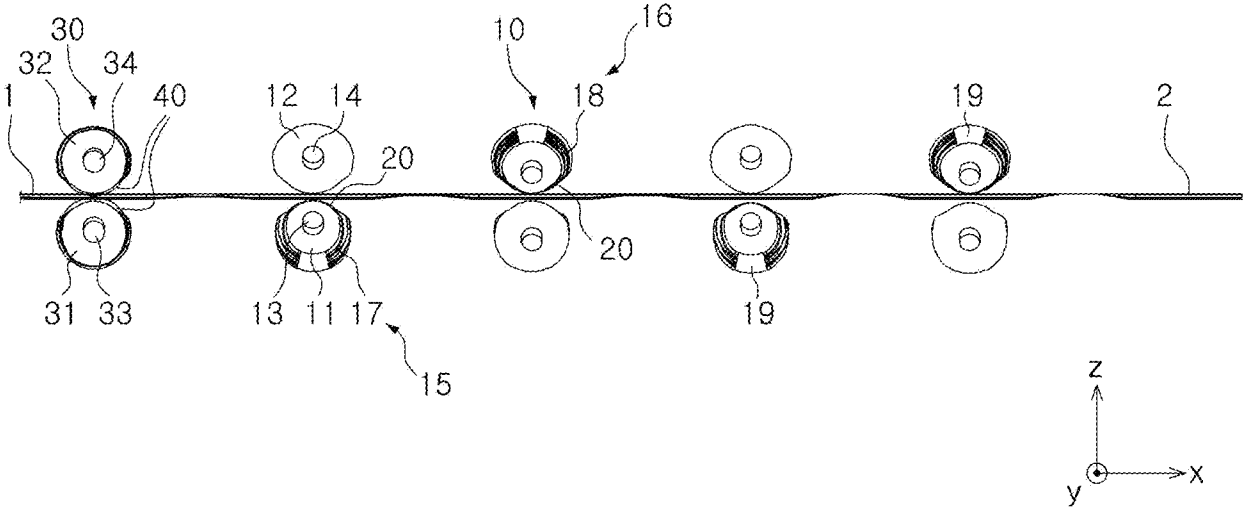
【FIG. 9】

【FIG. 10】
(a)
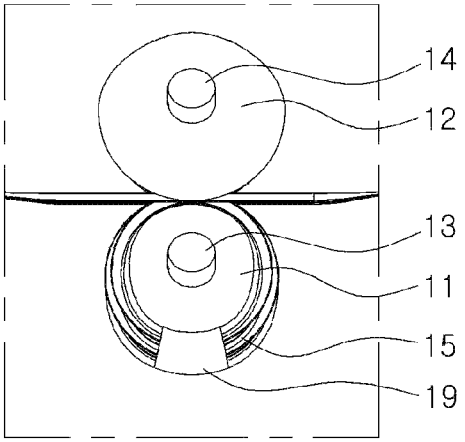
(b)
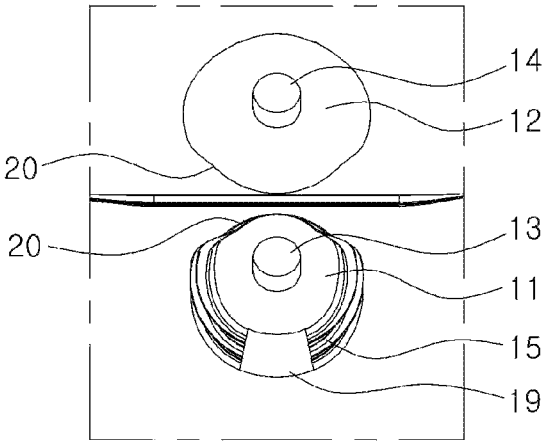

APPARATUS FOR ROLL STAMPING

CROSS-REFERENCE OF RELATED APPLICATIONS

This application is the U.S. National Phase under 35 U.S.C. § 371 of International Patent Application No. PCT/KR2021/011489, filed on Aug. 27, 2021, which in turn claims the benefit of Korean Application No. 10-2020-0119876, filed on Sep. 17, 2020, the entire disclosures of which applications are incorporated by reference herein.

TECHNICAL FIELD

The present disclosure relates to an apparatus for roll stamping that is capable of expanding a shape range of a product.

BACKGROUND ART

In a general roll forming (RF) method, only a component with a uniform section in a length direction may be formed. However, with a flexible roll forming (FRF) method, a component with a variable section may be formed by moving a rotation roll in a linear manner and in a curved manner in a traveling direction, a width direction, or a thickness direction of a material.

However, in a case of the flexible roll forming method, since a transition region of the variable section continuously receives tensile and compressive forces in the direction of travel of the material, warpage occurs in lower and side portions of the material, which results in a problem that a shape error continuously occurs in lower and side portions of a product. In addition, the flexible roll forming method has a problem in that a movement device with a complicated configuration is further required to move the rolling contact of the rotation roll in a linear manner or curved manner.

In order to solve the problem, the present applicant has proposed an apparatus for roll stamping as described in Korean Patent Laid-Open Publication No. 10-2013-0131872. The apparatus for roll stamping may reduce a product shape error and may form a component with a variable sectional shape without a complicated device.

However, the apparatus for roll stamping described above has a limitation in a range of a variable section change rate. For example, in a case in which a radius of curvature of the variable section is small or a height of the variable section is large, a phenomenon in which a pair of rotation rolls interfere with each other and overlap each other, and a phenomenon that the material is caught between the pair of rolls because a gap between the rolls is smaller than a thickness of the material may occur. In a case in which such phenomena occur, not only may the roll be damaged, but also the product may not be formed.

DISCLOSURE

Technical Problem

An aspect of the present disclosure is to provide an apparatus for roll stamping that is capable of expanding a shape range of a product without limitation due to, for example, a radius of curvature or a height of a variable section.

Technical Solution

According to an aspect of the present disclosure, an apparatus for roll stamping includes: an inclined roll set including a first rotation roll and a second rotation roll rotating while facing each other, have fixed positions and angles, and are inclined with respect to a traveling material, in which a first forming portion for forming the material is formed on an outer surface of the first rotation roll, the first forming portion includes a first circumferential groove portion inclined at an oblique angle rather than a right angle with respect to a rotation shaft of the first rotation roll, a second forming portion for forming the material is formed on an outer surface of the second rotation roll, the second forming portion includes a first circumferential protrusion part inclined at an oblique angle rather than a right angle with respect to a rotation shaft of the second rotation roll, and the first forming portion and the second forming portion may have shapes corresponding to each other and registering with each other.

Advantageous Effects

As set forth above, according to an exemplary embodiment in the present disclosure, as the inclined rotation roll is applied, a radius of curvature or height of a variable section that was not able to be achieved in the past may be achieved, thereby expanding a formable product shape range and improving efficiency in formation.

DESCRIPTION OF DRAWINGS

FIG. 1 is a perspective view illustrating an apparatus for roll stamping according to a first exemplary embodiment in the present disclosure.

FIG. 2 is a plan view of FIG. 1.

FIG. 3 is a cross-sectional view taken along line I-I of FIG. 2.

FIG. 4 is a cross-sectional view taken along line II-II of FIG. 2.

FIG. 5 is enlarged perspective views of a first rotation roll and a second rotation roll.

FIG. 6 is a schematic cross-sectional view illustrating a process in which a material is formed into a product having a variable sectional shape by the apparatus for roll stamping according to the first exemplary embodiment in the present disclosure.

FIG. 7 is views for comparing interference between rolls in the apparatuses for roll stamping according to the related art and the present disclosure.

FIG. 8 is a perspective view illustrating an apparatus for roll stamping according to a second exemplary embodiment in the present disclosure.

FIG. 9 is a front view of FIG. 8.

FIG. 10 is a view illustrating and comparing inclined roll sets according to the first exemplary embodiment and the second exemplary embodiment in the present disclosure.

BEST MODE FOR INVENTION

Hereinafter, the present disclosure will be described in detail with reference to the accompanying drawings. It is to be noted that in providing reference numerals to components of the respective drawings, the same components will be denoted by the same reference numerals even though they are illustrated in different drawings.

FIG. 1 is a perspective view illustrating an apparatus for roll stamping according to a first exemplary embodiment in the present disclosure, and FIG. 2 is a plan view of FIG. 1. FIG. 3 is a cross-sectional view taken along line I-I of FIG. 2, and FIG. 4 is a cross-sectional view taken along line II-II of FIG. 2. FIG. 5 is an enlarged perspective view of a first rotation roll and a second rotation roll.

The apparatus for roll stamping according to the first exemplary embodiment in the present disclosure may include a plurality of inclined roll sets 10.

The inclined roll set 10 may include a first rotation roll 11 and a second rotation roll 12 having fixed positions and angles.

Here, unlike rolls for flexible roll forming, the first rotation roll 11 and the second rotation roll 12 of the inclined roll set 10 do not move in a traveling direction (X), a width direction (Y), or a thickness direction (Z) of a material 1 during formation, and an angle of a horizontally turned roll shaft and an angle of an inclined roll shaft with respect to the traveling direction (X) of the material are not changed. Therefore, in one inclined roll set, the first rotation roll and the second rotation roll maintain set postures and directions at installed positions.

The first rotation roll 11 and the second rotation roll 12 may include rotation shafts 13 and 14 parallel to each other and forming portions (for example, 15 and 16) formed on outer surfaces thereof.

The first rotation roll 11 and the second rotation roll 12 included in the inclined roll set 10 may be arranged in an inclined manner. That is, the rotation shafts 13 and 14 of the first rotation roll and the second rotation roll of the inclined roll set are parallel to each other, are not parallel to a horizontal plane of the material 1, and are inclined at a predetermined inclination angle $\alpha$.

Referring to FIGS. 3 through 5, a generatrix line L of the outer surface of the first rotation roll 11 is not parallel to a center line O of the rotation shaft 13 of the first rotation roll 11 and is inclined at the above-described inclination angle $\alpha$. The inclination angle $\alpha$ is an angle between the center line O of the rotation shaft 13 and the generatrix line L.

A generatrix line L of the outer surface of the second rotation roll 12 is not parallel to a center line O of the rotation shaft 14 of the second rotation roll and is inclined at the above-described inclination angle $\alpha$.

The first rotation roll 11 and the second rotation roll 12 included in the inclined roll set 10 may have a substantially truncated cone shape, but are not necessarily limited thereto.

A drive motor (not illustrated) may be connected to at least one of the rotation shafts 13 and 14 of the first rotation roll 11 and the second rotation roll 12, and a transmission mechanism (not illustrated) such as a gear or belt mechanism may be connected between the drive motor and the rotation shaft. Since the rotation shaft, the drive motor, and the connection therebetween are widely known, detailed descriptions of configurations and functions thereof will be omitted in the present specification and drawings.

The first rotation roll 11 may include a first forming portion 15 formed to have a variable section along a circumference on an outer surface thereof. The second rotation roll 12 may include a second forming portion 16 that is formed to have a variable section along a circumference on an outer surface thereof in such a way as to correspond to the first forming portion.

The first forming portion 15 may be formed in such a way that an internal angle or a depth of the first forming portion 15 is changed along the circumference of the first rotation roll 11, and the first forming portion may have a shape corresponding to and registering with the second forming portion 16 of the second rotation roll 12.

For example, the first forming portion 15 may include a first circumferential groove portion 17 inclined at an oblique angle $\beta$ rather than a right angle with respect to the center line O of the rotation shaft 13 of the first rotation roll 11.

Optionally, the first forming portion 15 may include a second circumferential protrusion part 21 that is adjacent to the first circumferential groove portion 17 and has a predetermined angle with respect to the center line O of the rotation shaft 13 of the first rotation roll 11.

An inclined surface 23 may be formed between the first circumferential groove portion 17 and the second circumferential protrusion part 21 of the first forming portion 15.

In addition, a transition part 19 connecting the first circumferential groove portion 17 or the second circumferential protrusion part 21 may be formed on one side of the first rotation roll 11. Such a transition part is, for example, a part that smoothly connects misaligned portions where one end of the first groove portion does not meet the other end of the first groove portion after one rotation because the first groove portion is inclined with respect to the rotation shaft 13 of the first rotation roll. FIG. 5 (*a*) illustrates the transition part of the first rotation roll.

For example, the second forming portion 16 may include a first circumferential protrusion part 18 inclined at an oblique angle $\beta$ rather than a right angle with respect to the center line O of the rotation shaft 14 of the second rotation roll 12. The first circumferential protrusion part may be formed to correspond to and register with the first circumferential groove portion 17 of the first forming portion 15.

Optionally, the second forming portion 16 may include a second circumferential groove portion 22 that is adjacent to the first circumferential protrusion part 18 and has a predetermined angle with respect to the center line O of the rotation shaft 14 of the second rotation roll 12. The second circumferential groove portion may be formed to correspond to and register with the second circumferential protrusion part 21 of the first forming portion 15.

An inclined surface 24 may be formed between the first circumferential protrusion part 18 and the second circumferential groove portion 22 of the second forming portion 16.

In addition, a transition part 19 connecting the first circumferential protrusion part 18 or the second circumferential groove portion 22 may be formed on one side of the second rotation roll 12. Such a transition part is, for example, apart that smoothly connects misaligned portions where one end of the first protrusion part does not meet the other end of the first protrusion part after one rotation because the first protrusion part is inclined with respect to the rotation shaft 14 of the second rotation roll. FIG. 5 (*b*) illustrates the transition part of the second rotation roll.

When the continuously supplied material 1 having a plate shape passes between the first rotation roll 11 and the second rotation roll 12 configured as described above, the first rotation roll and the second rotation roll rotate while facing each other, and at the same time, the first forming portion 15 and the second forming portion 16 press opposite sides of the material to form a variable sectional shape in the material.

For example, the first circumferential groove portion 17 and the first circumferential protrusion part 18 may register with each other while having the material 1 interposed therebetween to form a first bent part 7 in the material or change an angle of the first bent part. In addition, the second circumferential protrusion part 21 and the second circumferential groove portion 22 register with each other while having the material interposed therebetween to form a second bent part 8 in the material at the same time as the first bent part 7 or change an angle of the second bent part.

Accordingly, the first forming portion 15 and the second forming portion 16 may form the bent parts 7 and 8 in the material 1 at a desired bending angle on opposite sides in the width direction (Y).

The plurality of inclined roll sets 10 each including the first rotation roll 11 and the second rotation roll 12 may be arranged at predetermined intervals in the traveling direction (X) of the material 1.

For example, referring back to FIGS. 1 and 2, the plurality of inclined roll sets 10 may be misaligned on opposite sides based on the center of the material 1 in the width direction (Y) in a zigzag manner in such a way as not to interfere with each other. As the plurality of inclined roll sets are arranged in multiple stages and misaligned, bending angles of portions forming side walls 5 in a recessed part 3 of a product 2 on opposite sides of the material may be gradually changed while alternately passing through the inclined roll sets in multiple stages.

However, the arrangement of the inclined roll sets 10 is not necessarily limited thereto, and for example, in a case in which a width of the material 1 is relatively large, pairs of inclined roll sets may be arranged in parallel on opposite sides based on the center of the material in the width direction (Y) at predetermined intervals in the traveling direction (X) of the material.

At this time, the plurality of first rotation rolls 11 and the plurality of second rotation rolls 12 included in the plurality of inclined roll sets 10 may be inclined at the same inclination angle. However, the inclination angle is not necessarily limited thereto, and for example, the inclination angle of the rotation roll may be different for each inclined roll set.

In addition, the plurality of inclined roll sets 10 may be arranged linearly, for example, in a straight line, in the traveling direction x of the material 1. As a result, an efficient use of a space is enabled without unnecessarily increasing a space required for the apparatus for roll stamping.

For example, the first forming portion 15 of the first rotation roll 11 of the inclined roll set 10 disposed downstream on the left side in the traveling direction x of the material 1 may have a sectional shape different from that of the first forming portion of the first rotation roll of the inclined roll set disposed upstream on the left side, that is, a changed internal angle or depth of the first forming portion in such a way that the material passing through the inclined roll sets in multiple stages sequentially has a variable sectional shape.

At this time, since the second forming portion 16 of the second rotation roll 12 has a sectional shape corresponding to and registering with the first forming portion 15 of the first rotation roll 11, the second forming portion of the second rotation roll of the inclined roll set disposed downstream on the left side may have a sectional shape different from that of the second forming portion of the second rotation roll of the inclined roll set disposed upstream on the left side, that is, a changed protrusion part angle or protrusion length (from the rotation shaft having the same diameter).

For example, the inclined roll set 10 disposed downstream has a smaller internal angle between the first groove portion 17 of the first forming portion 15 and the first protrusion part 18 of the second forming portion 16, and thus, the portions forming the side walls 5 in the recessed part 3 of the product 2 in the material 1 may be finally bent toward the center of the material in the width direction (Y) at a desired angle.

In this way, the material 1 may be gradually formed into the product 2 having a variable sectional shape by passing through the inclined roll sets 10 in multiple stages. In particular, in application of high-strength steel, a product is precisely and easily formed without shape errors while preventing the material from being broken during the formation due to weak formability, and a product with a variable sectional shape may be manufactured without a separate complicated rotation roll movement device.

The apparatus for roll stamping according to the first exemplary embodiment in the present disclosure may further include a plurality of horizontal roll sets 30.

The horizontal roll set 30 may include a third rotation roll 31 and a fourth rotation roll 32 having fixed positions and angles.

Here, unlike rolls for flexible roll forming, the third rotation roll 31 and the fourth rotation roll 32 of the horizontal roll set 30 do not move in the traveling direction (X), the width direction (Y), or the thickness direction (Z) of the material during formation, and an angle of a horizontally turned roll shaft with respect to the traveling direction (X) of the material is not changed. Therefore, in one horizontal roll set 30, the third rotation roll 31 and the fourth rotation roll 32 maintain set postures and directions at installed positions.

The third rotation roll 31 and the fourth rotation roll 32 may include rotation shafts 33 and 34 parallel to each other and forming portions (for example, 35 and 36) formed on outer surfaces thereof.

The third rotation roll 31 and the fourth rotation roll 32 included in the horizontal roll set 30 may be horizontally arranged. That is, the rotation shafts 33 and 34 of the third rotation roll and the fourth rotation roll of the horizontal roll set are parallel to each other and are parallel to the horizontal plane of the material 1.

A drive motor (not illustrated) may be connected to at least one of the rotation shafts 33 and 34 of the third rotation roll 31 and the fourth rotation roll 32, and a transmission mechanism (not illustrated) such as a gear or belt mechanism may be connected between the drive motor and the rotation shaft. Since the rotation shaft, the drive motor, and the connection therebetween are widely known, detailed descriptions of configurations and functions thereof will be omitted in the present specification and drawings.

The third rotation roll 31 may include at least one engraved forming portion 35 formed to have a variable section along a circumference on an outer surface thereof. The fourth rotation roll 32 may include at least one embossed forming portion 36 formed to have a variable section along a circumference on an outer surface thereof in such a way as to correspond to the engraved forming portion.

The engraved forming portion 35 may be formed in such a way that a width or a depth is changed along the circumference of the third rotation roll 31, and the engraved forming portion may have a shape corresponding to and registering with the embossed forming portion 36 of the fourth rotation roll 32.

For example, the engraved forming portion 35 formed on the third rotation roll 31 of the horizontal roll set 30 and the embossed forming portion 36 formed on the fourth rotation roll 32 may be formed to be inclined or bent an angle rather than a right angle with respect to the rotation shafts 33 and 34 of the respective rotation rolls.

In this case, a transition part 39 connecting the engraved forming portion 35 may be formed on one side of the third rotation roll 31. In addition, a transition part 39 connecting the embossed forming portion 36 may be formed on one side of the fourth rotation roll 32.

When the continuously supplied material 1 having a plate shape passes between the third rotation roll 31 and the fourth rotation roll 32 configured as described above, the third rotation roll and the fourth rotation roll rotate while facing each other, and at the same time, the engraved forming portion 35 and the embossed forming portion 36 press opposite sides of the material to form a variable sectional shape in the material.

Accordingly, as illustrated in FIGS. 1 and 2, the engraved forming portion 35 and the embossed forming portion 36 may form the recessed part 3 having a variable width or variable depth in the material 1.

Optionally, each of the third rotation roll 31 and the fourth rotation roll 32 may include a forming portion in which the engraved forming portion and the embossed forming portion are combined.

The plurality of horizontal roll sets 30 each including the third rotation roll 31 and the fourth rotation roll 32 may be arranged at predetermined intervals in the traveling direction (X) of the material 1. As the plurality of horizontal roll sets are arranged in multiple stages, a part of the material may be bent and formed little by little while passing through the horizontal roll sets in multiple stages.

The engraved forming portion 35 of the third rotation roll 31 of the horizontal roll set 30 disposed downstream in the traveling direction x of the material 1 may have a sectional shape different from that of the engraved forming portion of the third rotation roll of the horizontal roll set disposed upstream, that is, a changed inclination of internal opposite side surfaces 37, in such a way that the material passing through the horizontal roll sets in multiple stages sequentially has a variable sectional shape.

At this time, since the embossed forming portion 36 of the fourth rotation roll 32 has a sectional shape corresponding to and registering with the engraved forming portion 35 of the third rotation roll 31, the embossed forming portion of the fourth rotation roll of the horizontal roll set disposed downstream may have a sectional shape different from that of the embossed forming portion of the fourth rotation roll of the horizontal roll set disposed upstream, that is, a changed inclination of external opposite side surfaces 38.

For example, the horizontal roll set 30 disposed downstream has higher inclinations of the internal opposite side surfaces 37 of the engraved forming portion 35 and the external opposite side surfaces 38 of the embossed forming portion 36, and thus, finally, portions forming the side walls 5 in the recessed part 3 of the product 2 in the material 1 may be bent toward the center of the material at a desired angle.

As illustrated in FIGS. 1 and 2, the plurality of horizontal roll sets 30 may be disposed upstream of the plurality of inclined roll sets 10 in the traveling direction (X) of the material 1, but are not necessarily limited thereto. For example, the plurality of horizontal roll sets 30 may be disposed downstream of the plurality of inclined roll sets 10, or the horizontal roll sets 30 and the inclined roll sets 10 may be alternately arranged in the traveling direction (X) of the material as necessary.

Alternatively, depending on the shape of the product, the inclined roll set may be disposed on one side based on the center of the material 1 in the width direction (Y), and the horizontal roll set may be disposed on the other side in such a way as to be parallel to the inclined roll set or be misaligned with the inclined roll set.

Therefore, in a case in which the plurality of horizontal roll sets and the plurality of inclined roll sets are properly arranged according to design and used, the formation efficiency may be further increased.

FIG. 6 is a schematic cross-sectional view illustrating a process in which the material is formed into the product having a variable sectional shape by the apparatus for roll stamping according to the first exemplary embodiment in the present disclosure.

Referring to FIG. 6, in a case in which the plurality of horizontal roll sets 30 are disposed upstream of the plurality of inclined roll sets 10 in the traveling direction (X) of the material 1, the plurality of horizontal roll sets are arranged in multiple stages, so that opposite sides of the material in the width direction (Y) may be bent and formed little by little from A to E while passing through the horizontal roll sets in multiple stages.

The internal opposite side surfaces 37 of the engraved forming portion 35 of the third rotation roll 31 of each horizontal roll set have an inclination changed from the horizontal roll set disposed upstream to the horizontal roll set disposed downstream, so that the material 1 passing through the horizontal roll sets 30 in multiple stages sequentially has a variable sectional shape.

Since the embossed forming portion 36 of the fourth rotation roll 32 of each horizontal roll set 30 has a sectional shape corresponding to and registering with the engraved forming portion 35 of the third rotation roll 31, it is a matter of course that the external opposite side surfaces 38 of the embossed forming portion of the fourth rotation roll of each horizontal set have an inclination changed from the horizontal roll set disposed upstream to the horizontal roll set disposed downstream.

For example, the horizontal roll set 30 disposed downstream has higher inclinations of the internal opposite side surfaces 37 of the engraved forming portion 35 and the external opposite side surfaces 38 of the embossed forming portion 36, and thus, the material 1 may be formed to have inclined parts 6 inclined with respect to the horizontal plane.

Then, in a case in which the plurality of inclined roll sets 10 are arranged in such a way as to be misaligned on opposites sides based on the center of the material 1 in the width direction (Y) in a zigzag manner, as the plurality of inclined roll sets are arranged in multiple stages and misaligned, bending angles of the inclined parts 6 forming the side walls 5 in the recessed part 3 of the product 2 on opposite sides of the material may be gradually changed from F to I while alternately passing through the inclined roll sets in multiple stages.

The first groove portion 17 of the first forming portion 15 of the first rotation roll 11 of each inclined roll set disposed on the left side in the traveling direction (X) of the material may have an internal angle or depth changed from the inclined roll set disposed upstream to the inclined roll set disposed downstream, so that the material 1 passing through the inclined roll sets 10 in multiple stages sequentially has a variable sectional shape.

At this time, since the second forming portion 16 of the second rotation roll 12 has a sectional shape corresponding to and registering with the first forming portion 15 of the first rotation roll 11, the first protrusion part 18 of the second forming portion of the second rotation roll of each inclined roll set disposed on the left side may have an angle or protrusion length changed from the inclined roll set disposed upstream to the inclined roll set disposed downstream.

Similarly, the first groove portion 17 of the first forming portion 15 of the first rotation roll 11 of each inclined roll set 10 disposed on the right side in the traveling direction x of the material 1 may have an internal angle or depth changed toward the inclined roll set disposed downstream, and the first protrusion part 18 of the second forming portion 16 of the second rotation roll 12 of each inclined roll set 10 disposed on the right side in the traveling direction x of the material 1 may have an angle or protrusion length changed toward the inclined roll set disposed downstream.

For example, the inclined roll set 10 disposed downstream has a smaller internal angle between the first groove portion 17 of the first forming portion 15 and the first protrusion part 18 of the second forming portion 16, and thus, finally, the inclined parts 6 of the material 1 may be bent almost at a right angle to form the side walls 5 in the recessed part 3 of the product 2.

In this way, the material 1 may be gradually bent and formed into the product 2 having the recessed part 3 with a variable sectional shape by passing through the horizontal roll sets 30 in multiple stages and the inclined roll sets 10 in multiple stages. As a result, the material may be formed into the product accurately and easily without shape errors. In addition, a product with a variable sectional shape may be manufactured without a separate complicated rotation roll movement device.

FIG. 7 is views for comparing interference between rolls in the apparatuses for roll stamping according to the related art and the present disclosure, (a) is a schematic view illustrating interference between the rolls in the apparatus for roll stamping according to the related art, and (b) is a schematic view illustrating that there is no interference between the rolls in the inclined roll set 10 of the apparatus for roll stamping according to the present disclosure.

The apparatus for roll stamping according to the related art includes a plurality of roll sets each including, for example, a pair of horizontal rolls R1 and R2 rotating while facing each other and including forming portions for stamping on outer surfaces thereof. In this case, when an angle between a rotation shaft of a corresponding roll and a side wall of a product is increased, there is a high risk of interference between the rolls or between the roll and the material.

In a case in which the product has a bent shape (for example, see FIGS. 1 and 2), for example, when a height of the product is 20 mm and a radius of curvature of a variable section is 1,500 mm, interference between the rolls R1 and R2 or between the roll and the material occurs as illustrated in (a) of FIG. 7.

As another example, even when the height of the product is 40 mm and the radius of curvature of the variable section is 3,000 mm, interference between the rolls R1 and R2 or between the roll and the material occurs as illustrated in (a) of FIG. 7.

In (a) of FIG. 7, it may be seen that the rolls R1 and R2 come into contact and interfere with each other.

The apparatus for roll stamping according to the present disclosure includes, in addition to the plurality of horizontal roll sets 30, the inclined roll set 10 in which the first rotation roll 11 and the second rotation roll 12 are inclined with respect to the horizontal plane of the material 1.

As described above, the apparatus for roll stamping according to the present disclosure includes the inclined first and second rotation rolls 11 and 12, that is, the rotation shafts 13 and 14 of the rotation rolls are inclined, and thus, the angle between the rotation shaft of the rotation roll and the portion forming the side wall 5 in the recessed part 3 of the product 2 in the material 1 may be made small.

For example, when the height of the product is 20 mm and the radius of curvature of the variable section is 1,500 mm, in a case in which the first and second rotation rolls 11 and 12 inclined at an inclination angle α (see FIGS. 3 and 4) of 30 degrees are applied, smooth forming may be performed without interference between the rotation rolls 11 and 12 or between the rotation roll and the material, as illustrated in (b) of FIG. 7.

Similarly, it may be confirmed that, even when the height of the product is 40 mm and the radius of curvature of the variable section is 3,000 mm, in a case in which the first and second rotation rolls 11 and 12 inclined at an inclination angle α (see FIGS. 3 and 4) of 30 degrees are applied, interference between the rotation rolls 11 and 12 or between the rotation roll and the material is prevented as illustrated in (b) of FIG. 7.

As such, in the apparatus for roll stamping according to the first exemplary embodiment in the present disclosure, the rotation shafts 13 and 14 of the first and second rotation rolls 11 and 12 are inclined to decrease the angle between the rotation shaft and the portion forming the side wall in the recessed part 3 of the product 2 in the material 1, and thus, the material may be formed into the product having a relatively complex variable sectional shape without interference between the rolls or between the roll and the material, which occurs when the radius of curvature of the variable section is small or the height of the product is high.

FIG. 8 is a perspective view illustrating an apparatus for roll stamping according to a second exemplary embodiment in the present disclosure, and FIG. 9 is a front view of FIG. 8.

Here, the apparatus for roll stamping according to the second exemplary embodiment in the present disclosure is different only in that avoiding parts 20 and 40 are formed on the rotation rolls, and other components are configured the same as those described in the first exemplary embodiment in the present disclosure. Therefore, detailed descriptions of the configuration and operation of other components will be omitted.

The apparatus for roll stamping according to the second exemplary embodiment in the present disclosure may include a plurality of inclined roll sets 10.

The inclined roll set 10 may include a first rotation roll 11 and a second rotation roll 12 having fixed positions and angles. The first rotation roll and the second rotation roll may include rotation shafts 13 and 14 parallel to each other and forming portions (for example, 15 and 16) formed on outer surfaces thereof.

Further, each of the first rotation roll 11 and the second rotation roll 12 may include the avoiding part 20 formed to have a predetermined length in a circumferential direction.

The plurality of inclined roll sets 10 each including the first rotation roll 11 and the second rotation roll 12 may be arranged at predetermined intervals in a traveling direction (X) of a material 1.

For example, as illustrated in FIG. 8, the plurality of inclined roll sets 10 may be misaligned on opposite sides based on the center of the material 1 in the width direction (Y) in a zigzag manner in such a way as not to interfere with each other. However, the arrangement of the inclined roll sets 10 is not necessarily limited thereto.

The first rotation roll 11 and the second rotation roll 12 included in the inclined roll set 10 may be arranged in an inclined manner. That is, the rotation shafts 13 and 14 of the first rotation roll and the second rotation roll of the inclined roll set are parallel to each other, are not parallel to a horizontal plane of the material 1, and are inclined at a predetermined inclination angle α (see FIGS. 3 and 4).

The first rotation roll 11 may include a first forming portion 15 formed to have a variable section along a circumference on an outer surface thereof. The second rotation roll 12 may include a second forming portion 16 that is formed to have a variable section along a circumference on an outer surface thereof in such a way as to correspond to the first forming portion.

The first forming portion 15 may be formed in such a way that an internal angle or a depth of the first forming portion 15 is changed along the circumference of the first rotation roll 11, and the first forming portion may have a shape corresponding to and registering with the second forming portion 16 of the second rotation roll 12.

A transition part 19 connecting a first circumferential groove portion 17 or a second circumferential protrusion part 21 inclined with respect to the rotation shaft 13 of the first forming portion 15 may be formed on one side of the first rotation roll 11.

A transition part 19 connecting a first circumferential protrusion part 18 or a second circumferential groove portion 22 inclined with respect to the rotation shaft 14 of the second forming portion 16 may be formed on one side of the second rotation roll 12.

The avoiding part 20 of each of the first rotation roll 11 and the second rotation roll 12 may be formed to have a predetermined length in the circumferential direction of each rotation roll on a side opposite to the transition part 19, for example.

In the avoiding part 20, a radial distance from a center line O of each of the rotation shafts 13 and 14 (see FIGS. 3 and 4) to the outer surface of each of the rotation rolls 11 and 12 at an arbitrary point on the center line O is shorter than a natural radius of the rotation roll centered on the point.

Alternatively, although not illustrated, the avoiding parts 20 may be formed in such a way as to be recessed toward the rotation shafts 13 and 14 from the outer surfaces of the rotation rolls 11 and 12.

Accordingly, the first rotation roll 11 and the second rotation roll 12 in which the avoiding parts 20 are formed do not come into contact with the material 1 at the avoiding parts, and the material passing through such an inclined roll set 10 may pass without being subjected to formation.

In other words, since the avoiding parts 20 are formed to have a predetermined length from the outer circumferences of the first rotation roll 11 and the second rotation roll 12 in the circumferential direction, formation of the material 1 is not performed by the predetermined length when the material 1 passes between the avoiding parts of the first rotation roll and the second rotation roll.

The avoiding part 20 of the first rotation roll 11 and the avoiding part 20 of the second rotation roll 12 may be arranged to face each other, but are not necessarily limited thereto.

When the continuously supplied material 1 having a plate shape passes between the first rotation roll 11 and the second rotation roll 12 configured as described above, the first rotation roll and the second rotation roll rotate while facing each other, and at the same time, the first forming portion 15 and the second forming portion 16 press opposite sides of the material to form a variable sectional shape in a partial region of the material.

Accordingly, the first forming portion 15 and the second forming portion 16 may form the partial region of the material 1 at a desired bending angle on opposite sides in the width direction (Y).

Subsequently, when the material 1 passes between the avoiding parts 20 of the first rotation roll 11 and the second rotation roll 12, the material does not come into contact with the first rotation roll and the second rotation roll, and thus, the material may pass without formation of other partial regions of the material.

FIG. 10 is a view illustrating and comparing the inclined roll sets according to the first exemplary embodiment and the second exemplary embodiment in the present disclosure.

As illustrated in (a) of FIG. 10, the inclined roll set 10 according to the first exemplary embodiment does not include the avoiding part, and thus, the first forming portion 15 of the first rotation roll 11 and the second forming portion 16 of the second rotation roll may press opposite sides of the material 1 during one rotation of the rotation rolls to continuously form a variable sectional shape.

On the other hand, as illustrated in (b) of FIG. 10, in the inclined roll set 10 according to the second exemplary embodiment, the material 1 does not come into contact with any rotation roll when passing between the avoiding parts of the first and second rotation rolls 11 and 12 due to the avoiding parts 20 facing each other, so that the material is not subjected to the formation by the predetermined length.

In this way, in a case in which the avoiding part 20 of the first rotation roll 11 and the avoiding part 20 of the second rotation roll 12 are arranged to face each other, since the material 1 does not come into contact with both the first rotation roll and the second rotation roll, the formation is possible without changing the inclined roll set 10 even when an interval between the regions formed by the forming portions 15 and 16 is changed, and eventually, the products 2 having various lengths may be formed, which is advantageous.

More specifically, first, in a case in which a traveling speed (m/min) of the material 1 is constant, a rotation speed (rev/min) of the first and second rotation rolls 11 and 12 of the plurality of inclined roll sets 10 at the time of formation of the partial region of the material by the forming portions 15 and 16 may be maintained constant.

When the avoiding part 20 of the first rotation roll 11 and the avoiding part 20 of the second rotation roll 12 are arranged to face each other, and the material 1 thus passes without formation of other partial regions of the material 1, a length of the region of the material that is not subjected to the formation may be adjusted by decreasing (or completely stopping the rotation) or increasing the rotation speed of the plurality of inclined roll sets 10.

That is, the products 2 having the same shape and different overall lengths may be formed by maintaining the traveling speed of the material 1 constant and making the rotation speed of the inclined roll set 10 when formation is performed and the rotation speed of the inclined roll set 10 when formation is not performed different from each other.

For example, the products 2 such as vehicle beam members having the same formed regions and having various lengths may be formed and manufactured by one apparatus for roll stamping and provided.

The apparatus for roll stamping according to the second exemplary embodiment in the present disclosure may further include a plurality of horizontal roll sets 30.

The horizontal roll set 30 may include a third rotation roll 31 and a fourth rotation roll 32 having fixed positions and postures. The third rotation roll and the fourth rotation roll may include rotation shafts 33 and 34 parallel to each other and forming portions (for example, 35 and 36) formed on outer surfaces thereof.

Further, each of the third rotation roll 31 and the fourth rotation roll 32 may include the avoiding part 40 formed to have a predetermined length in the circumferential direction.

The plurality of horizontal roll sets 30 each including the third rotation roll 31 and the fourth rotation roll 32 may be arranged at predetermined intervals in the traveling direction (X) of the material 1.

The third rotation roll 31 and the fourth rotation roll 32 included in the horizontal roll set 30 may be horizontally arranged. That is, the rotation shafts 33 and 34 of the third rotation roll and the fourth rotation roll of the horizontal roll set are parallel to each other and are parallel to the horizontal plane of the material 1.

The third rotation roll 31 may include at least one engraved forming portion 35 formed to have a variable section along a circumference on an outer surface thereof. The fourth rotation roll 32 may include at least one embossed forming portion 36 formed to have a variable section along a circumference on an outer surface thereof in such a way as to correspond to the engraved forming portion.

The engraved forming portion 35 may be formed in such a way that a width or a depth is changed along the circumference of the third rotation roll 31, and the engraved forming portion may have a shape corresponding to and registering with the embossed forming portion 36 of the fourth rotation roll 32.

For example, the engraved forming portion 35 formed on the third rotation roll 31 of the horizontal roll set 30 and the embossed forming portion 36 formed on the fourth rotation roll 32 may be formed to be inclined or bent an angle rather than a right angle with respect to the rotation shafts 33 and 34 of the respective rotation rolls.

Optionally, each of the third rotation roll 31 and the fourth rotation roll 32 may include a forming portion in which the engraved forming portion and the embossed forming portion are combined as illustrated in FIG. 8.

The avoiding part 40 of each of the third rotation roll 31 and the fourth rotation roll 32 may be formed to have a predetermined length in the circumferential direction of each rotation roll on a side opposite to the forming portion 35 or 36, for example.

In the avoiding part 40, a radial distance from the center line of each of the rotation shafts 33 and 34 to the outer surface at an arbitrary position on the center line is shorter than a radius of each of the rotation rolls 31 and 32 centered on the position.

Alternatively, although not illustrated, the avoiding parts 40 may be formed in such a way as to be recessed toward the rotation shafts 33 and 34 from the outer surfaces of the rotation rolls 31 and 32.

Accordingly, the third rotation roll 31 and the fourth rotation roll 32 in which the avoiding parts 40 are formed do not come into contact with the material 1 at the avoiding parts, and the material passing through such a horizontal roll set 30 may pass without being subjected to formation.

In other words, since the avoiding parts 40 are formed to have a predetermined length from the outer circumferences of the third rotation roll 31 and the fourth rotation roll 32 in the circumferential direction, formation of the material 1 is not performed by the predetermined length when the material 1 passes between the avoiding parts of the third rotation roll and the fourth rotation roll.

The avoiding part 40 of the third rotation roll 31 and the avoiding part 40 of the fourth rotation roll 32 may be arranged to face each other, but are not necessarily limited thereto.

When the continuously supplied material 1 having a plate shape passes between the third rotation roll 31 and the fourth rotation roll 32 configured as described above, the third rotation roll and the fourth rotation roll rotate while facing each other, and at the same time, the engraved forming portion 35 and the embossed forming portion 36 press opposite sides of the material to form a variable sectional shape in the material.

Accordingly, the engraved forming portion 35 and the embossed forming portion 36 may form the recessed part 3 having a variable width or variable depth in the material 1.

Subsequently, when the material 1 passes between the avoiding parts 40 of the third rotation roll 31 and the fourth rotation roll 32, the material does not come into contact with the third rotation roll and the fourth rotation roll, and thus, the material may pass without formation of other partial regions of the material.

For example, in a case in which the avoiding part 40 of the third rotation roll 31 and the avoiding part 40 of the fourth rotation roll 32 are arranged to face each other, since the material 1 does not come into contact with both the third rotation roll and the fourth rotation roll, the formation is possible without changing the horizontal roll set 30 even when an interval between the regions formed by the forming portions 35 and 36 is changed, and eventually, the products 2 having various lengths may be formed.

More specifically, first, in a case in which the traveling speed (m/min) of the material 1 is constant, a rotation speed (rev/min) of the third and fourth rotation rolls 31 and 32 of the plurality of horizontal roll sets 30 at the time of formation of the partial region of the material by the forming portions 35 and 36 may be maintained constant.

When the avoiding part 40 of the third rotation roll 31 and the avoiding part 40 of the fourth rotation roll 32 are arranged to face each other, and the material 1 thus passes without formation of other partial regions of the material 1, a length of the region that is not subjected to the formation may be adjusted by decreasing (or completely stopping the rotation) or increasing the rotation speed of the plurality of horizontal roll sets 30.

That is, the products 2 having the same shape and different overall lengths may be formed by maintaining the traveling speed of the material 1 constant and making the rotation speed of the horizontal roll set 30 when formation is performed and the rotation speed of the horizontal roll set 10 when formation is not performed different from each other.

The avoiding parts 40 of the plurality of horizontal roll sets 30 and the avoiding parts 20 of the plurality of inclined roll sets 10 may be in synchronization with each other, and for example, the rotating avoiding parts 20 and 40 may be positioned adjacent to the material at the same portion of the material to make the material pass.

The plurality of horizontal roll sets 30 may be disposed upstream of the plurality of inclined roll sets 10 in the traveling direction (X) of the material 1, but are not necessarily limited thereto. In a case in which the plurality of horizontal roll sets and the plurality of inclined roll sets are properly arranged according to design and used, the formation efficiency may be further increased.

In this way, the material 1 may be gradually formed into the product 2 having a variable sectional shape by passing through the horizontal roll sets 30 in multiple stages and the inclined roll sets 10 in multiple stages. As a result, the material may be formed into the product accurately and easily without shape errors. In addition, a product with a variable sectional shape may be manufactured without a separate complicated rotation roll movement device.

In addition, in a case in which the avoiding parts 20 and are provided, the products 2 having various lengths may be formed without changing the roll set.

The spirit of the present disclosure has been illustratively described hereinabove, and those skilled in the art to which the present disclosure pertains may make various modifications and alterations without departing from the essential characteristics of the present disclosure.

Therefore, exemplary embodiments disclosed in the present specification and the drawings are not to limit the spirit of the present disclosure, but are to describe the present disclosure, and the spirit and scope of the present disclosure are not limited to these exemplary embodiments. The scope of the present disclosure should be interpreted by the following claims, and it should be interpreted that all the spirits equivalent to the following claims fall within the scope of the present disclosure.

DESCRIPTION OF REFERENCE NUMERALS

| | |
|---|---|
| 1: MATERIAL | 2: PRODUCT |
| 10: INCLINED ROLL SET | 11: FIRST ROTATION ROLL |
| 12: SECOND ROTATION ROLL | 13, 14: ROTATION SHAFT |
| 15: FIRST FORMING PORTION | 16: SECOND FORMING PORTION |
| 17: FIRST GROOVE PORTION | 18: FIRST PROTRUSION PART |
| 19, 39: TRANSITION PART | 20, 40: AVOIDING PART |
| 21: SECOND PROTRUSION PART | 22: SECOND GROOVE PORTION |
| 30: HORIZONTAL ROLL SET | 31: THIRD ROTATION ROLL |
| 32: FOURTH ROTATION ROLL | 33, 34: ROTATION SHAFT |
| 35: ENGRAVED FORMING PORTION | 36: EMBOSSED FORMING PORTION |
| 37: INTERNAL OPPOSITE SIDE SURFACES | 38: EXTERNAL OPPOSITE SIDE SURFACES |

The invention claimed is:

1. An apparatus for roll stamping, the apparatus comprising:

an inclined roll set including a first rotation roll and a second rotation roll rotating while facing each other, wherein each of the first rotation roll and the second rotation roll having a fixed position and an angle inclined with respect to a traveling direction of a material, wherein a first forming portion for forming the material is formed on an outer surface of the first rotation roll, the first forming portion includes a first circumferential groove portion inclined at an oblique angle rather than a right angle with respect to a rotation shaft of the first rotation roll, a second forming portion for forming the material is formed on an outer surface of the second rotation roll, the second forming portion includes a first circumferential protrusion part inclined at an oblique angle rather than a right angle with respect to a rotation shaft of the second rotation roll, and the first forming portion and the second forming portion have shapes corresponding to each other and registering with each other, the inclined roll sets are arranged in plural at predetermined intervals from each other in the traveling direction of the material, wherein in a case in which a number of inclined roll sets is plural, the inclined roll sets are arranged in such a way as to be misaligned on opposite sides based on a center of the material in a width direction in such a way as not to interfere with each other.

2. The apparatus of claim 1, wherein the rotation shaft of the first rotation roll and the rotation shaft of the second rotation roll are parallel to each other, are not parallel to a horizontal plane of the material, and are inclined with respect to the horizontal plane at a predetermined inclination angle.

3. The apparatus of claim 2, wherein a generatrix line of the outer surface of the first rotation roll is inclined with respect to a center line of the rotation shaft of the first rotation roll at the inclination angle, and a generatrix line of the outer surface of the second rotation roll is inclined with respect to a center line of the rotation shaft of the second rotation roll at the inclination angle.

4. The apparatus of claim 1, wherein the first forming portion further includes a second circumferential protrusion part that is adjacent to the first circumferential groove portion and has a predetermined angle with respect to the rotation shaft of the first rotation roll, the second forming portion further includes a second circumferential groove portion that is adjacent to the first circumferential protrusion part and has a predetermined angle with respect to the rotation shaft of the second rotation roll, and the second circumferential protrusion part and the second circumferential groove portion are formed to correspond to each other.

5. The apparatus of claim 1, wherein a transition part connecting the first circumferential groove portion is formed on a first side of the first rotation roll, and a transition part connecting the first circumferential protrusion part is formed on a first side of the second rotation roll.

6. The apparatus of claim 5, further comprising avoiding parts which are provided on a second side of the first rotation roll and a second side of the second rotation roll and between which the material passes without being subjected to formation.

7. The apparatus of claim 6, wherein the avoiding part is formed on a side opposite to the transition part and has a predetermined length in a circumferential direction of the rotation roll.

8. The apparatus of claim 6, wherein in the avoiding part, a radial distance from a center line of the rotation shaft of the first rotation roll or the second rotation roll to the outer surface of the rotation roll at an arbitrary point on the center line is shorter than a natural radius of the rotation roll centered on the point.

9. The apparatus of claim 6, wherein the avoiding part is formed to be recessed toward the rotation shaft from the outer surface of the first rotation roll or the second rotation roll.

10. The apparatus of claim 1, further comprising a horizontal roll set including a third rotation roll and a fourth rotation roll rotating while facing each other, have fixed positions and angles, and are horizontally arranged, wherein the third rotation roll includes at least one engraved forming portion formed to have a variable section along a circumference on an outer surface of the third rotation roll, and the fourth rotation roll includes at least one embossed forming portion formed to have a variable section along a circumference on an outer surface of the fourth rotation roll in such a way as to correspond to the engraved forming portion.

11. The apparatus of claim 10, wherein the third rotation roll and the fourth rotation roll each further include an avoiding part formed to have a predetermined length in a circumferential direction of the rotation roll to make the material pass without being subjected to formation.

12. The apparatus of claim 10, wherein a plurality of horizontal roll sets are disposed upstream of the plurality of inclined roll sets in the travelling direction of the material.

* * * * *